US007166803B2

(12) United States Patent
Sakurai et al.

(10) Patent No.: US 7,166,803 B2
(45) Date of Patent: Jan. 23, 2007

(54) PARALLEL-TRANSMISSION FLAT CABLE EQUIPPED WITH CONNECTOR UNIT

(75) Inventors: Atsushi Sakurai, Shinagawa (JP); Manabu Shimizu, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/119,730

(22) Filed: May 3, 2005

(65) Prior Publication Data

US 2006/0042816 A1 Mar. 2, 2006

(30) Foreign Application Priority Data

Sep. 2, 2004 (JP) ..... 2004-255797

(51) Int. Cl.
*H01B 7/08* (2006.01)

(52) U.S. Cl. ..... 174/117 F; 439/496

(58) Field of Classification Search ..... 174/117 F, 174/117 FF, 88 R; 439/496, 378, 495
See application file for complete search history.

(56) References Cited

U.S. PATENT DOCUMENTS 4,714,435 A * 12/1987 Stipanuk et al. ..... 439/496
4,717,435 A * 1/1988 Kawasaki et al. ..... 148/410
5,900,587 A * 5/1999 Piper et al. ..... 174/117 F
6,585,537 B1 * 7/2003 Lee ..... 439/358
6,589,074 B1 * 7/2003 Wu ..... 439/540.1
6,626,698 B1 * 9/2003 Matsumura ..... 439/496
6,653,569 B1 * 11/2003 Sung ..... 174/88 R
6,951,476 B1 * 10/2005 Saito et al. ..... 439/495
2006/0030215 A1 * 2/2006 Wu ..... 439/610

FOREIGN PATENT DOCUMENTS

JP 6-39480 10/1994
JP 2003-59593 2/2003
JP 2003-323923 11/2003

* cited by examiner

*Primary Examiner*—Chau N. Nguyen
(74) *Attorney, Agent, or Firm*—Staas & Halsey LLP

(57) ABSTRACT

A parallel-transmission flat cable that is equipped with a connector unit is provided. This parallel-transmission flat cable includes: a parallel-transmission flat cable member that has pairs of signal transmission paths and ground portions that are arranged alternately so as to enable parallel transmission, and has pairs of signal terminal portions and ground terminal portions exposed at either end of the parallel-transmission flat cable member; and a connector unit forming member that is provided at either end of the parallel-transmission flat cable member and forms a connector unit that has the signal terminal portions and the ground terminal portions of the parallel-transmission flat cable member serving as terminal portions thereof. In this structure, the connector unit is located at either end of the parallel-transmission flat cable member.

8 Claims, 15 Drawing Sheets

PARALLEL-TRANSMISSION FLAT CABLE EQUIPPED WITH CONNECTOR UNIT

BACKGROUND OF THE INVENTION

The present invention generally relates to parallel-transmission flat cables equipped with connector units, and, more particularly, to a parallel-transmission flat cable that is equipped with a connector unit and has end portions at either end thereof. The end portions can be connected directly to the contacts of a mating connector.

Examples of conventional data transmission methods include a regular transmission method by which one wire is used for each set of data, and a parallel-transmission method by which a pair of wires are used for each set of data so as to simultaneously transmit a positive signal and a negative signal that is of the same size as the positive signal but are directed in the opposite direction from the positive signal. The parallel-transmission method is more advantageous than the regular transmission method in that signal transmission with less noise influence can be performed. Accordingly, the parallel-transmission method is being more and more widely employed in the fields that require high-speed signal transmission.

Conventionally, to parallel-transmit signals between two devices or between two locations within a device, a cable that has pairs of wires contained in a double-cover tube is employed. Such a cable has a connector at either end, and the connector has contacts incorporated therein.

However, with such a conventional cable quipped with connectors, there have been problems that the production costs of the cable and the connectors are high, and accordingly, the cable becomes expensive. Also, the cable is large in size, and is not suitable for connecting one location to another within a small device.

Furthermore, the pairs of wires and the contacts of the connector that is mounted and fixed onto a printed board are connected via the contacts of the connector unit provided on either end of the cable. Therefore, the connecting portions between the ends of the pairs of wires and the contacts of the connector at either end of the cable might adversely affect the parallel-transmission characteristics.

SUMMARY OF THE INVENTION

A general object of the present invention is to provide parallel-transmission flat cables in which the above disadvantages are eliminated.

A more specific object of the present invention is to provide a parallel-transmission flat cable that is smaller than a conventional flat cable and is equipped with a connector unit.

The above objects of the present invention are achieved by a parallel-transmission flat cable that is equipped with a connector and includes: a parallel-transmission flat cable member that has pairs of signal transmission paths and ground portions that are arranged alternately so as to enable parallel transmission, and has pairs of signal terminal portions and ground terminal portions exposed at either end of the parallel-transmission flat cable member; and a connector unit forming member that is provided at either end of the parallel-transmission flat cable member and forms a connector unit that has the signal terminal portions and the ground terminal portions of the parallel-transmission flat cable member serving as terminal portions thereof. In this structure, the connector unit is located at either end of the parallel-transmission flat cable member.

In accordance with the present invention, two devices or two locations in a device can be connected to each other with a parallel-transmission flat cable, and excellent parallel-transmission characteristics can be achieved.

The above and other objects and features of the present invention will become more apparent from the following description taken in conjunction with the accompanying drawings.

DESCRIPTION OF THE PREFERRED EMBODIMENTS

The following is a description of embodiments of the present invention, with reference to the accompanying drawings.

Figure 1:
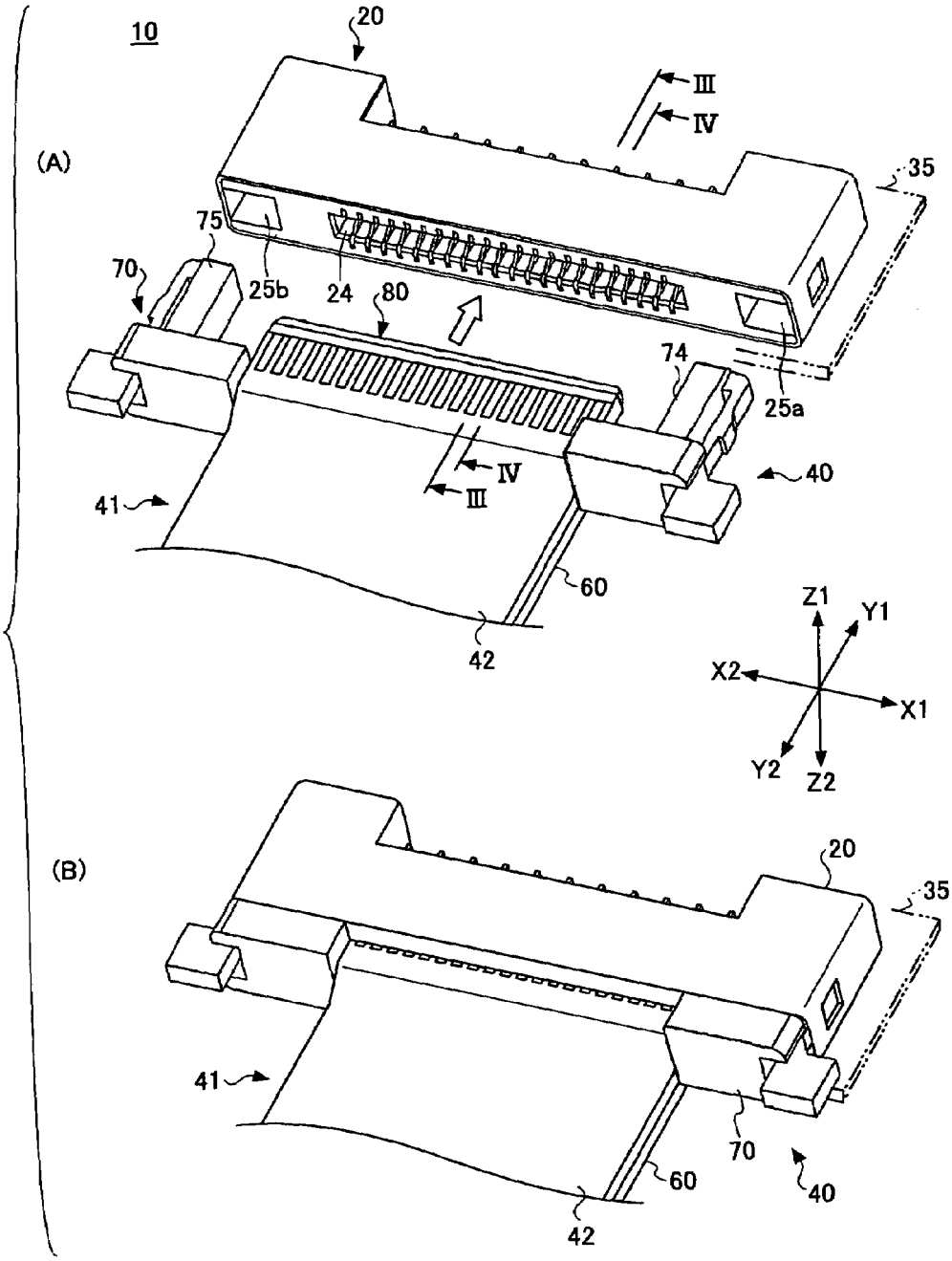
FIGS. 1A and 1B illustrate a parallel-transmission flexible printed cable connector device of a first embodiment of the present invention.
Figure 2:
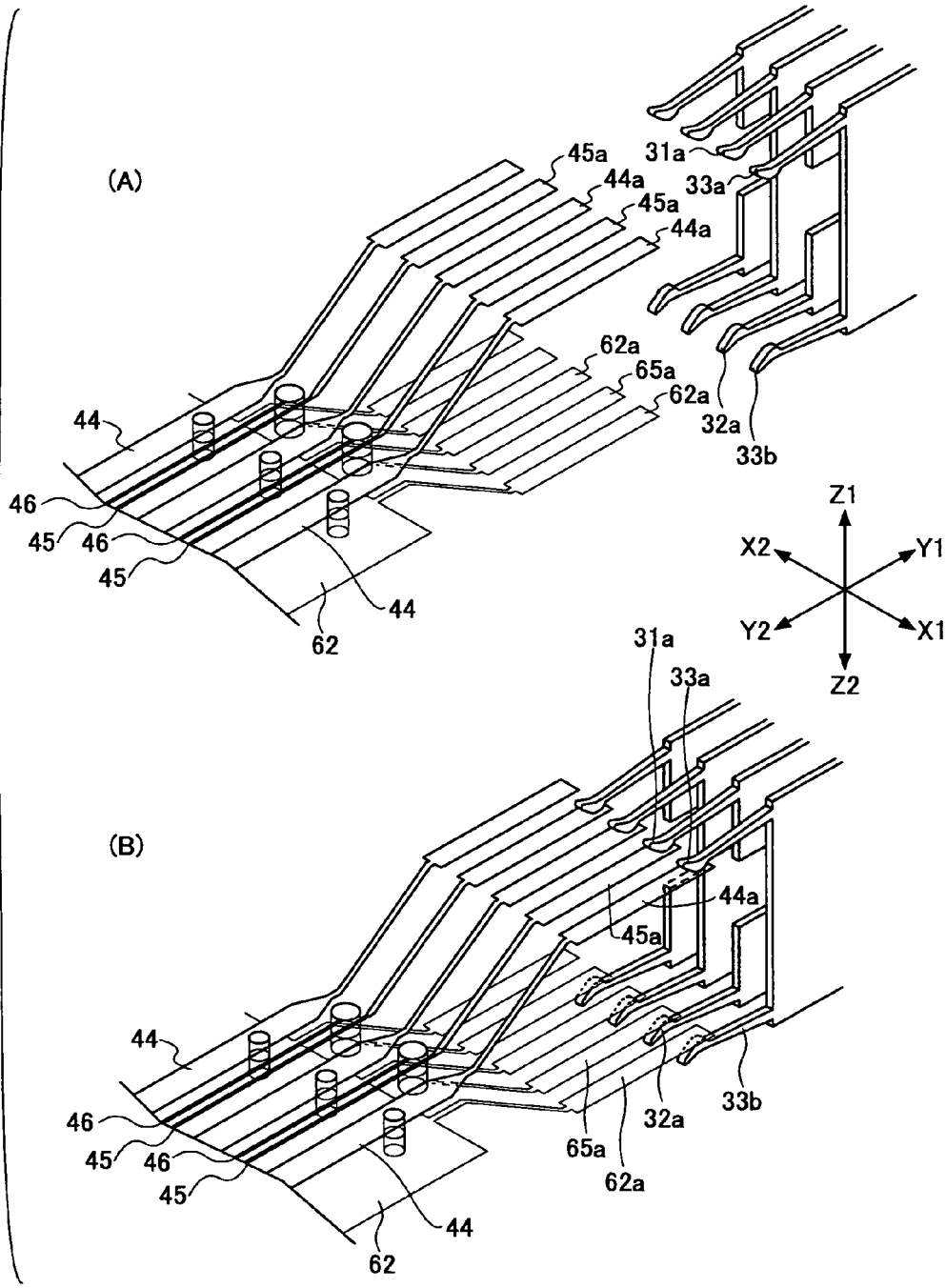
FIGS. 2A and 2B schematically illustrate the arrangement of the end portions of the plug-type connector unit and the arrangement of the contact portions of the socket.
Figure 3:
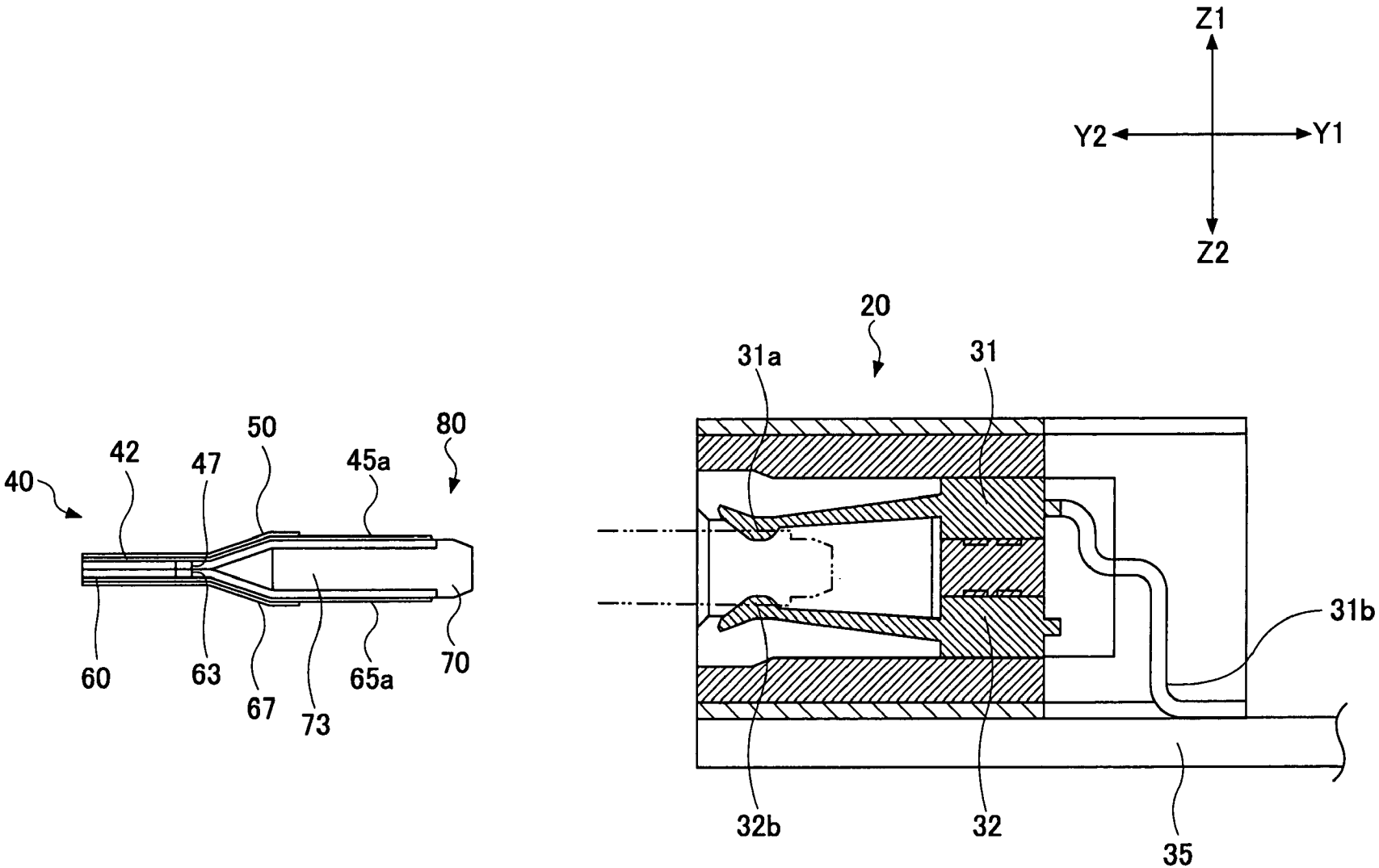
FIG. 3 is an enlarged cross-sectional view of the parallel-transmission flexible printed cable connector device, taken along the line III—III, along which a signal contact extends.
Figure 4:
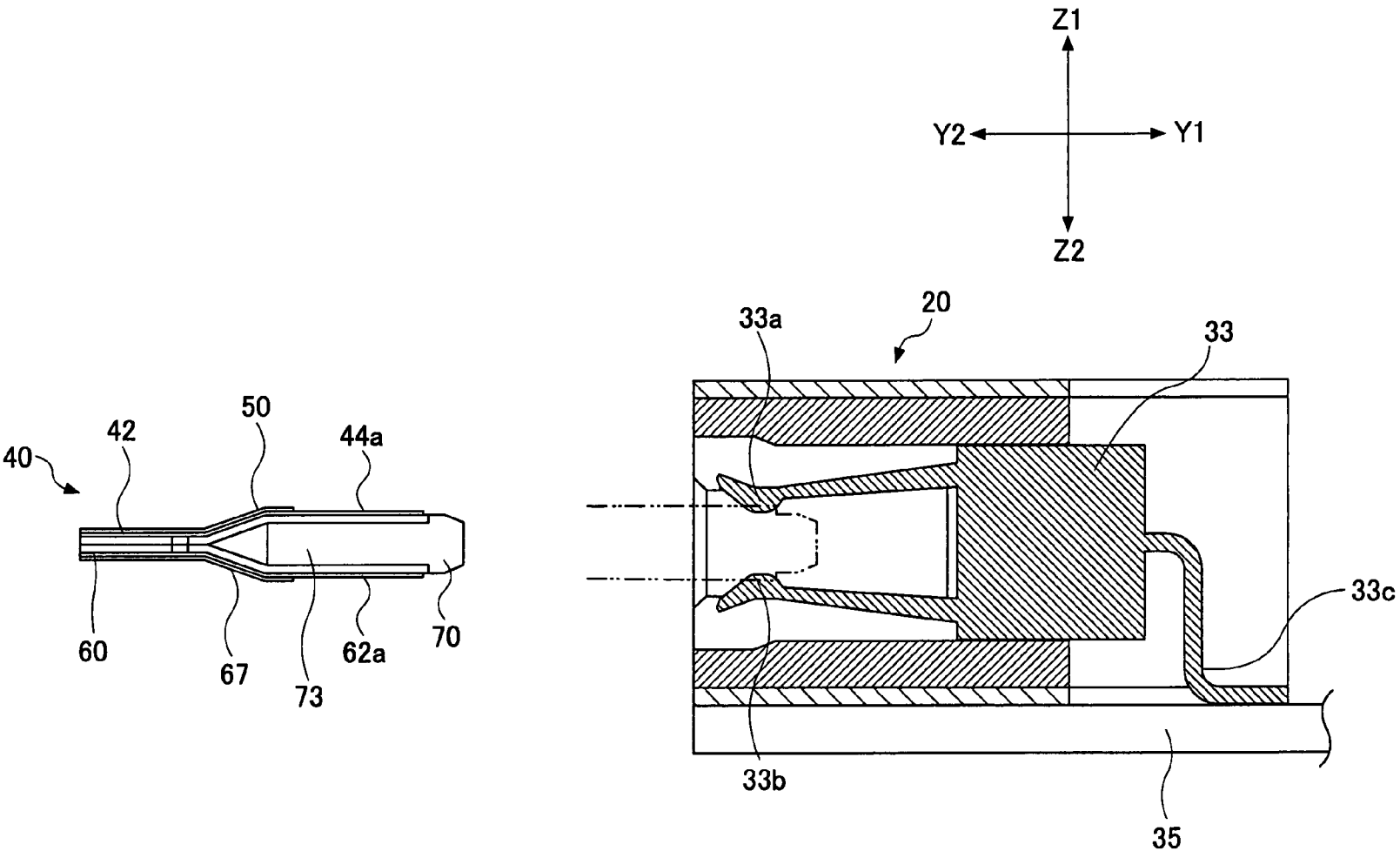
FIG. 4 is en enlarged cross-sectional view of the parallel-transmission flexible printed cable connector device, taken along the line IV—IV, along which a ground contact extends.
Figure 5:
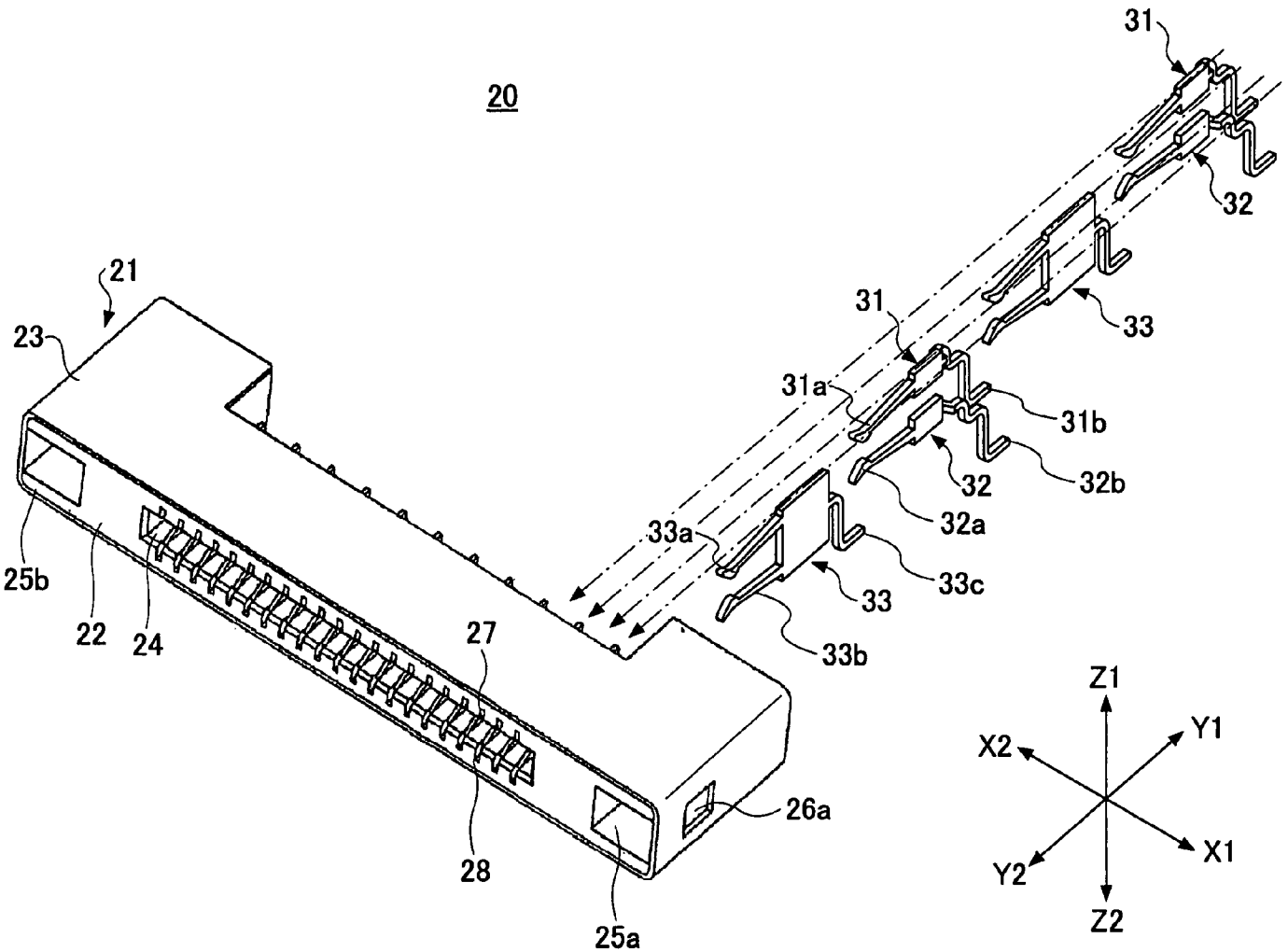
FIG. 5 is a perspective view of the socket and the contacts.
Figure 6:
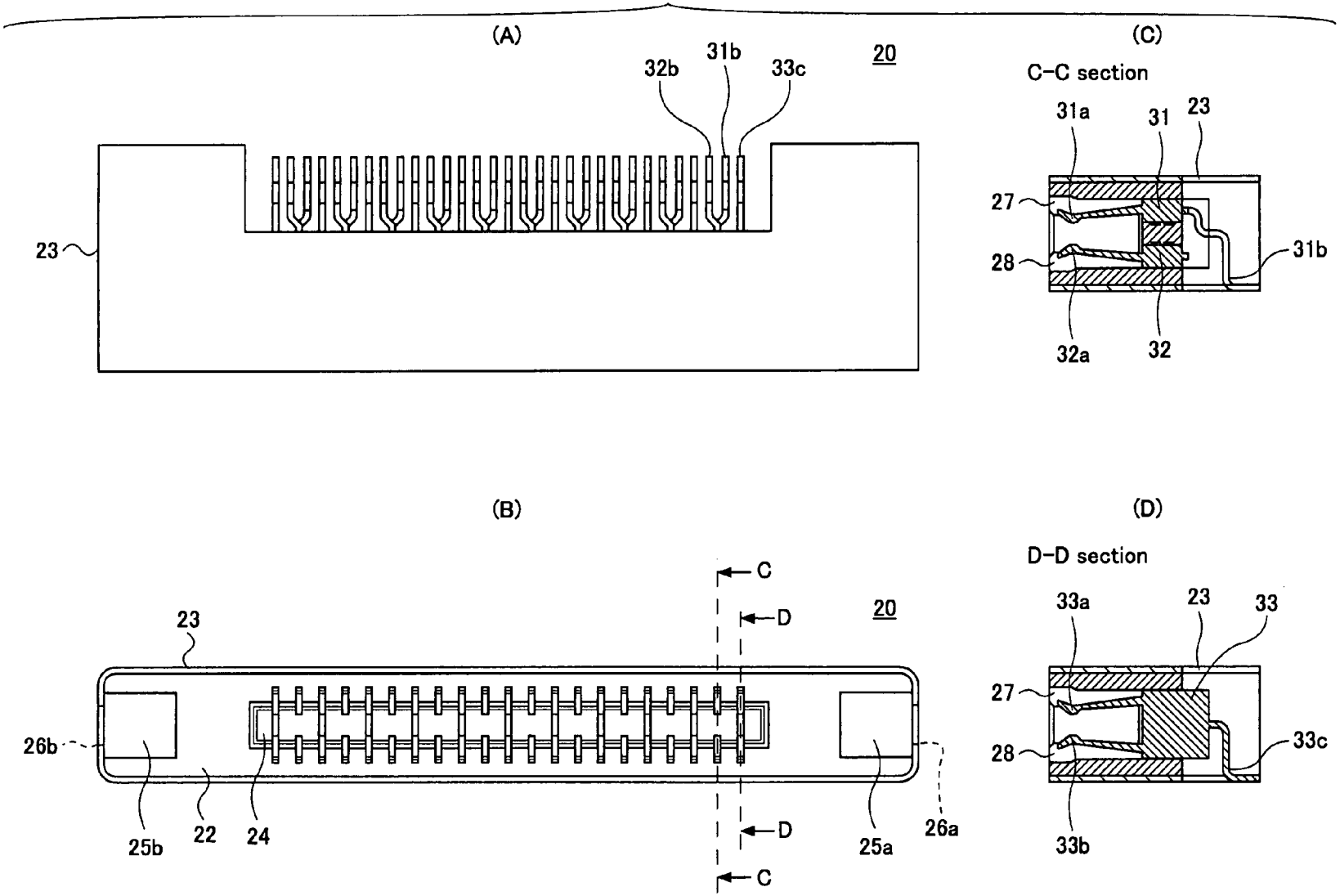
FIGS. 6A through 6D illustrate the socket.

FIGS. 1A and 1B illustrate a parallel-transmission flexible printed cable connector device 10 of a first embodiment of the present invention. The parallel-transmission flexible printed cable connector device 10 includes a socket 20 and a parallel-transmission flexible printed cable 40 equipped with a plug-type connector unit. In FIG. 1A, the parallel-transmission flexible printed cable 40 equipped with a plug-type connector unit faces the socket 20, before connected to the socket 20. In FIG. 1B, the parallel-transmission flexible printed cable 40 is connected to the socket 20. FIGS. 2A and 2B illustrate the arrangement of the end portions of the plug-type connector unit 80 mounted to the parallel-transmission flexible printed cable 40, and the arrangement of the contact portions of the socket 20. FIG. 2A illustrates the arrangement immediately before the connection illustrated in FIG. 1A is established. FIG. 2B illustrates the arrangement in the connected state shown in FIG. 1B. FIG. 3 is a cross-sectional view of the structure shown in FIG. 1A, taken along the line III—III, which extends in a signal contact. FIG. 4 is a cross-sectional view of the structure shown in FIG. 1A, taken along the line IV—IV, which extends in a ground contact. In each figure, X1-X2 and Z—Z represent the width direction and the height direction of the plug-type connector unit 80 of the parallel-transmission flexible printed cable 40 and the socket 20. Also, Y1 represents the direction in which the plug-type connector 80 is inserted into the socket 20, and Y2 represents the direction in which the plug-type connector unit 80 is pulled out of the socket 20.

[Socket 20]

First, the socket 20 is described. As shown in FIG. 5 and FIGS. 6A through 6D, the socket 20 is of a so-called right-angle type. This socket 20 has first and second signal contacts 31 and 32 each having a right-angle shape, and a ground contact 33 also having a right-angle shape. The first and second signal contacts 31 and 32 and the ground contact 33 are incorporated into the socket main body 21 in this order from the rear side (the Y1 side). The socket 21 has a socket component 22 housed in a metal-plate casing 23. The socket component 22 is a resin mold component with electric insulation properties.

The socket main body 21 has a long opening 24 that extends in the X1-X2 direction in which the plug-type connector unit 80 of the parallel-transmission flexible printed cable 40 is to be inserted. The opening 24 is located at the center of the socket main body 21. The opening 24 has guide holes 25*a* and 25*b* at both ends, and lock openings 26*a* and 26*b* on both end surfaces. Grooves 27 and 28 with which the contact portions are to be engaged are formed on the top surface and the bottom surface of the opening 24. The first signal contacts 31 and the second signal contacts 32 are arranged in pairs in the Z1-Z2 direction. The pair of first and second signal contacts 31 and 32 and the plate-like ground contacts 33 are alternately arranged in the X1-X2 direction. The first and second signal contacts 31 and 32 have contact portions 31*a* and 32*a*, and right-angle mounting terminal portions 31*b* and 32*b*. The ground contacts 33 have fork-like contact portions 33*a* and 33*b*, and right-angle mounting terminal portions 33*c*. The contact portions 31*a* and the contact portions 33*a* are engaged with the grooves 27 formed on the top surface of the opening 24. The contact portions 32*a* and the contact portions 33*b* are engaged with the grooves 28 of the opening 24. The mounting terminal portions 31*b*, 32*b*, and 33*c* are arranged on the rear surface side of the socket main body 21.

As shown in FIGS. 1 through 4, the mounting terminal portions 31*b*, 32*b*, and 33*c* are soldered to the pads on the printed board 35. Thus, the mounting terminal portions 31*b*, 32*b*, and 33*c* are mounted and fixed onto the printed board 35.

Next, the parallel-transmission flexible printed cable 40 equipped with a plug-type connector unit is described in detail.

Figure 7:
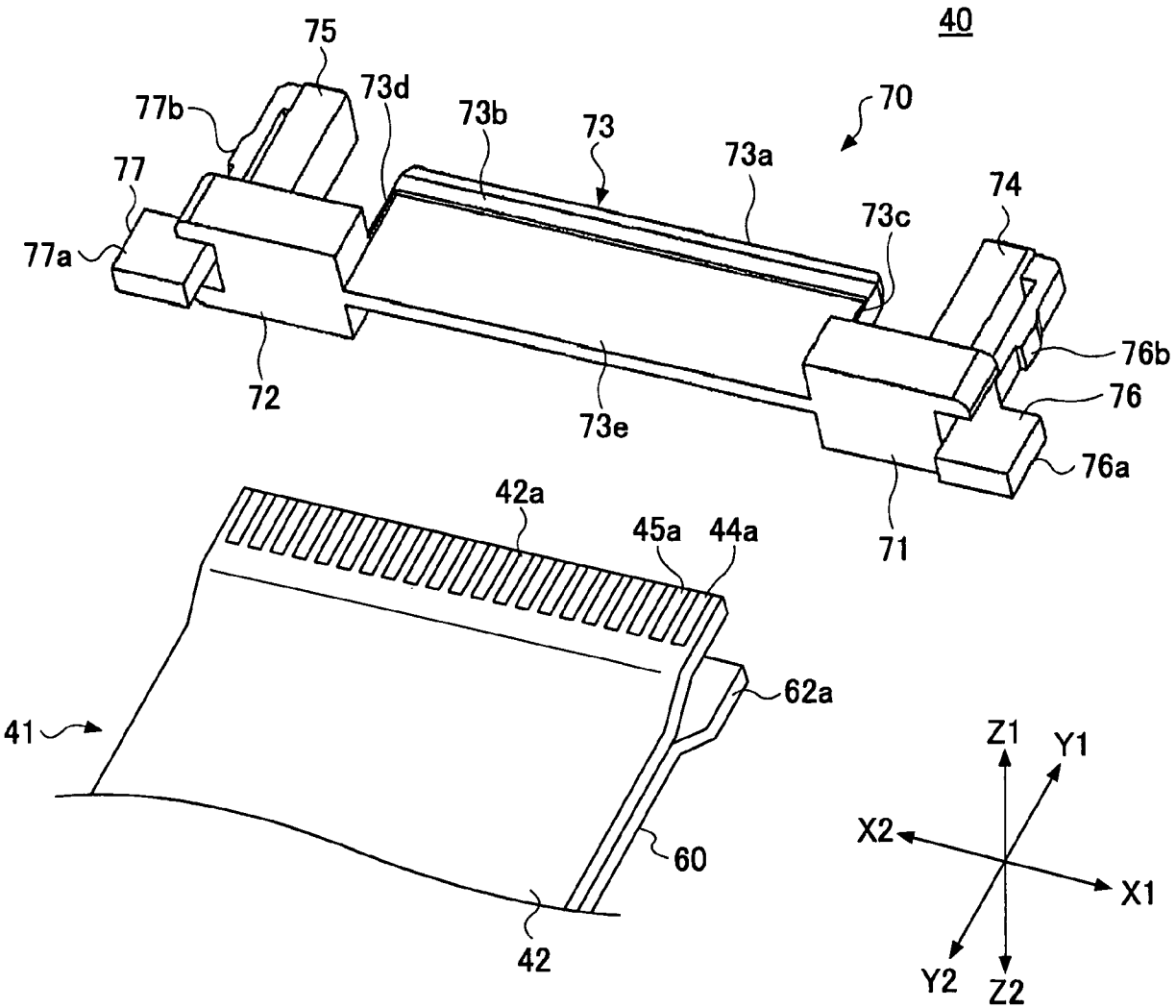
FIG. 7 is an exploded perspective view of an end portion of the parallel-transmission flexible printed cable member equipped with a plug-type connector unit.

FIG. 7 illustrates the parallel-transmission flexible printed cable 40 equipped with a plug-type connector unit, divided into a parallel-transmission flexible printed wiring board 41 (hereinafter referred to as the parallel-transmission flexible printed cable member 41) and a plug unit forming member 70.

The parallel-transmission flexible printed cable 40 equipped with a plug-type connector unit has the plug unit forming member 70 attached to either end of the parallel-transmission flexible printed cable member 41.

[Parallel-Transmission Flexible Printed Cable Member 41]

First, the parallel-transmission flexible printed cable (FPC) member 41 is described.

Figure 8:
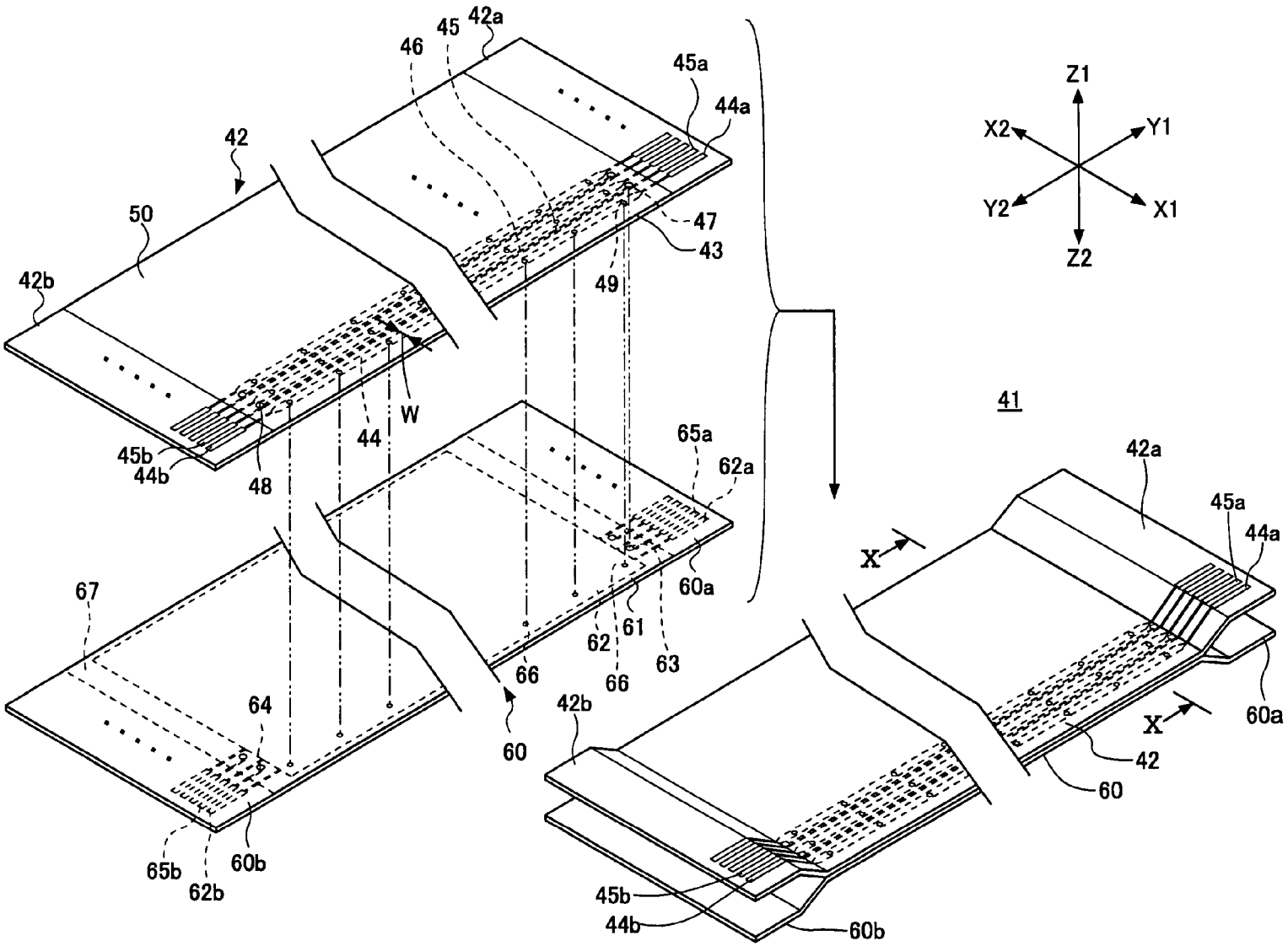
FIG. 8 is a perspective view of the parallel-transmission flexible printed cable member.
Figure 9:
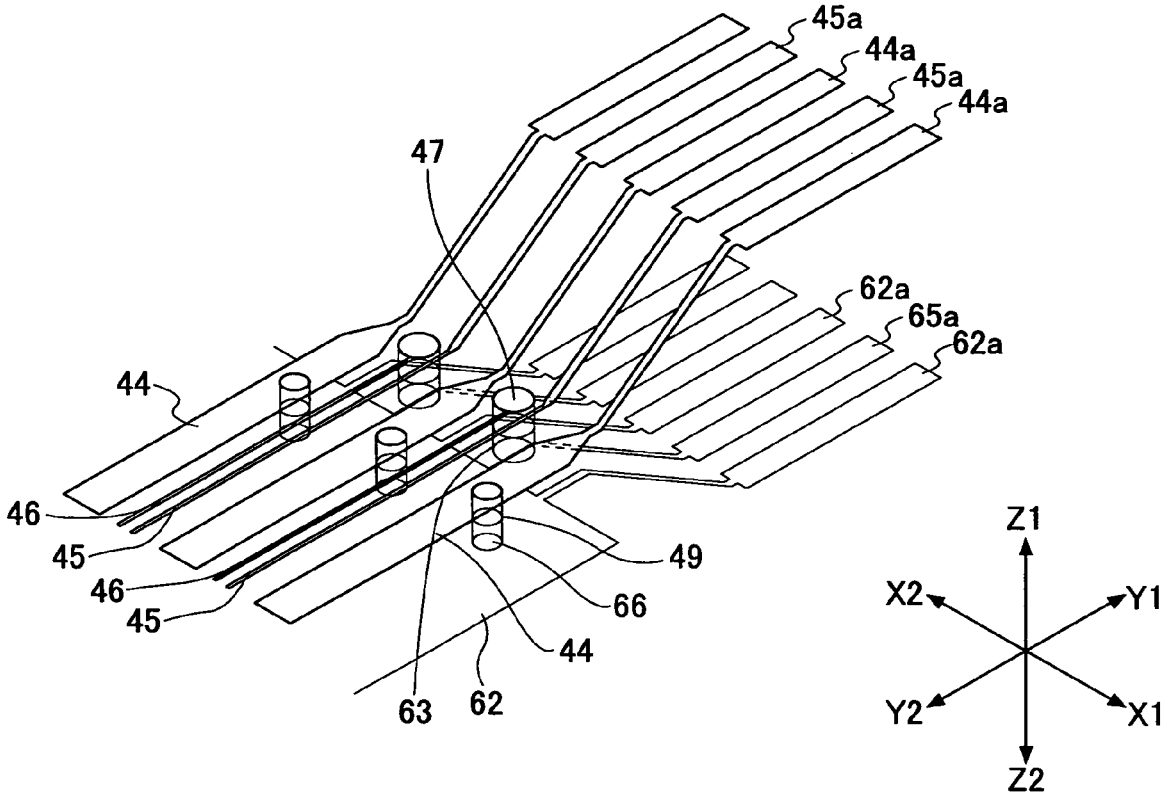
FIG. 9 is a perspective view schematically illustrating the structure of an end portion of the parallel-transmission flexible printed cable member shown in FIG. 8.
Figure 10:
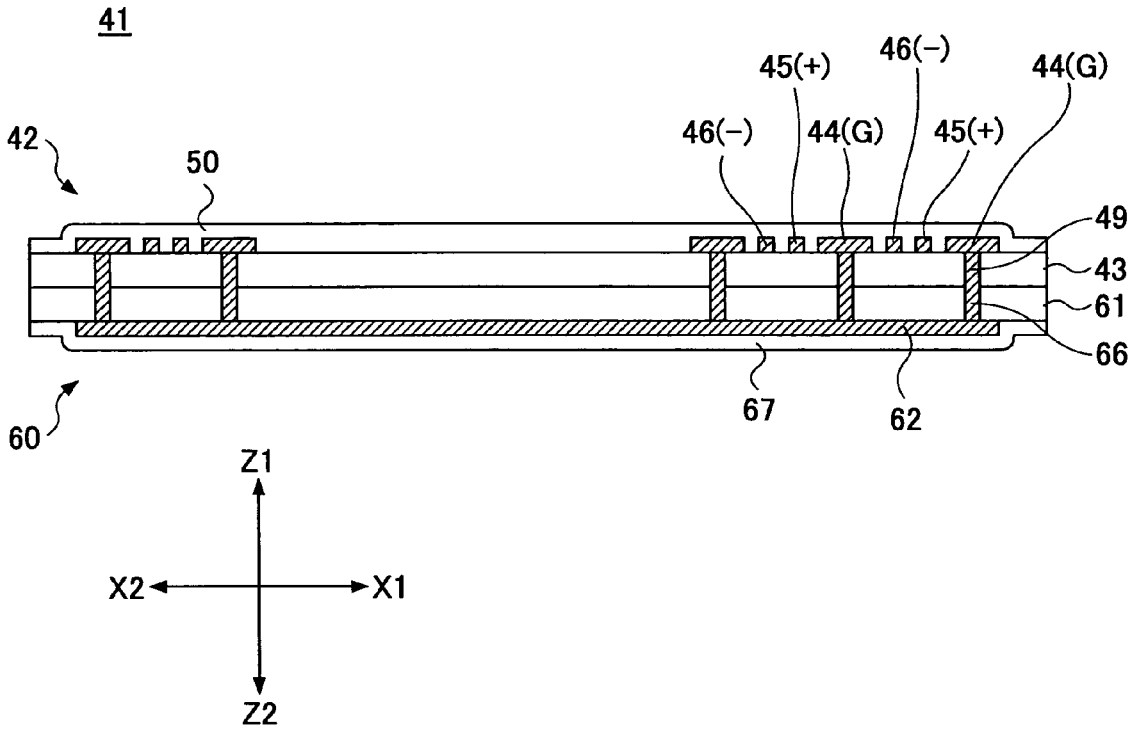
FIG. 10 is an enlarged cross-sectional view of the parallel-transmission flexible printed cable member, taken along the line of X—X of FIG. 8.
Figure 11:
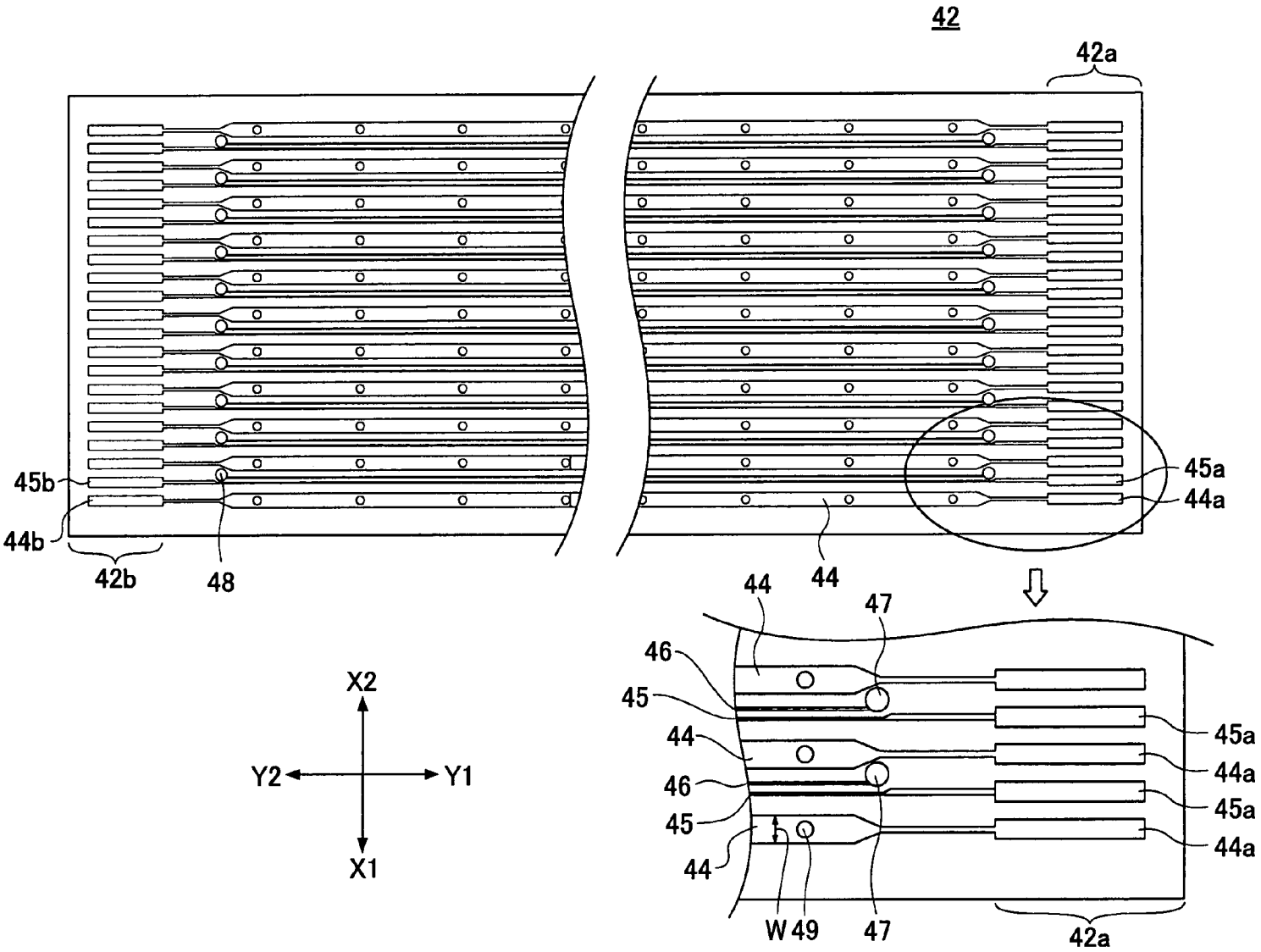
FIG. 11 is a plan view of the parallel-transmission flexible printed cable member of FIG. 8.
Figure 12:
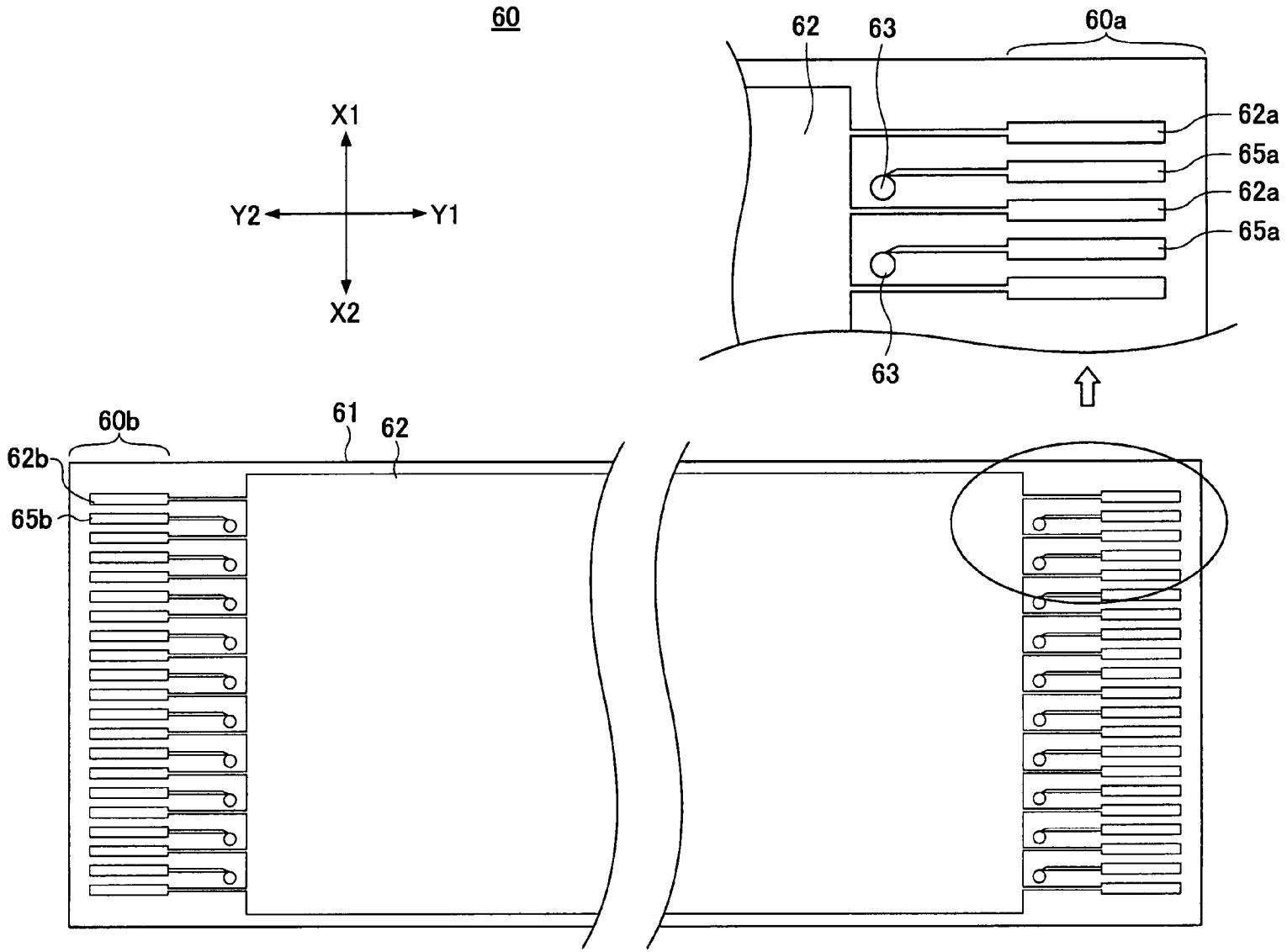
FIG. 12 is a bottom view of the parallel-transmission flexible printed cable member of FIG. 8.

FIG. 8 illustrates the structure of the parallel-transmission flexible printed cable member 41. FIG. 9 is an enlarged view of the terminal portion of an end portion of the parallel-transmission flexible printed cable member 41. FIG. 10 is a cross-sectional view of the parallel-transmission flexible printed cable member 41, taken along the line X—X of FIG. 8. FIG. 11 is a plan view of the parallel-transmission flexible printed cable member 41. FIG. 12 is a bottom view of the parallel-transmission flexible printed cable member 41. In FIGS. 11 and 12, surface protection film is not shown.

The parallel-transmission flexible printed cable member 41 has a laminated structure in which a first flexible printed wiring board 42 (hereinafter referred to as the first flexible printed cable 42) is placed on top of a second flexible printed wiring board 60 (hereinafter referred to as the second flexible printed cable 60). The first flexible printed cable 42 and the second flexible printed cable 60 are bonded to each other, except at the end portions.

The first flexible printed cable 42 has linear ground patterns 44, first signal line patterns 45, and second signal line patterns 46 formed in parallel with one another on the upper surface of a synthetic resin base sheet 43, as shown in FIGS. 8, 10, and 11. The first and second signal line patterns 45 and 46 are located very close to each other. The width W of each linear ground pattern 44 is greater than the width of each of the signal line patterns 45 and 46. Each pair of first and second signal patterns 45 and 46 located very close to each other are sandwiched by two linear ground patterns 44. The first signal line patterns 45 transmit positive signals, and the second signal line patterns transmit negative signals that have the same size as the positive signals but are directed in the opposite direction from the positive signals. The first and second signals line patterns 45 and 46 form pairs.

The end portion 42*a* of the first flexible printed cable 42 on the Y1 side has the ground terminal portions 44*a* at the ends of the linear ground patterns 44 and the first signal terminal portions 45*a* of the first signal line patterns 45 arranged alternately in the X1-X2 direction on the upper surface of the synthetic resin base sheet 43. The ends of the second signal line patterns 46 are connected to vias 47 that are located next to the end portion 42*a* and serve as terminal ends.

The end portion 42*b* of the first flexible printed cable 42 on the Y2 side has the ground terminal portions 44*b* at the ends of the linear ground patterns 44 and the first signal terminal portions 45*b* of the first signal line patterns 45 arranged alternately in the X1-X2 direction on the upper surface of the synthetic resin base sheet 43. The ends of the second signal line patterns 46 are connected to vias 48 that are located next to the end portion 42*b* and serve as terminal ends.

Also, each of the linear ground patterns 44 has vias 49 that penetrate the base sheet 43 and reach the lower surface of the base sheet 43.

A protection film 50 is formed on the upper surface of the first flexible printed cable 42, except at the end portions 42*a* and 42*b*. In this structure, the linear ground patterns 44, the first signal line patterns 45, the second signal line patterns 46, the vias 47 and 48 are covered with the protection film 50.

As shown in FIGS. 8, 10, and 12, the second flexible printed cable 60 has a plane-type ground pattern 62 formed on the lower surface of the synthetic resin base sheet 61, except at the end portions 60*a* and 60*b*. Also, vias 63 and 64 are formed at the locations corresponding to the vias 47 and 48 outside the plane-type ground pattern 62.

The end portion 60*a* on the Y1 side has ground terminal portions 62*a* and second signal terminal portions 65*a* arranged alternately in the X1-X2 direction. The ground terminal portions 62*a* extend from the plane-type ground pattern 62. The second signal terminal portions 65*a* continue to the vias 63.

The end portion 60*b* on the Y2 side has ground terminal portions 62*b* and second signal terminal portions 65*b* arranged alternately in the X1-X2 direction. The ground terminal portions 62*b* extend from the plane-type ground pattern 62. The second signal terminal portions 65*b* continue to the vias 64.

The plane-type ground pattern 62 has vias 66 formed at the locations corresponding to the vias 49. The vias 66 penetrate the base sheet 61 and reach the upper surface of the base sheet 43.

A protection film 67 is formed on the lower surface of the second flexible printed cable 60, except at the end portions 60*a* and 60*b*. In this structure, the plane-type ground pattern 62 and the vias 63 and 64 are covered with the protection film 67.

The first flexible printed cable 42 is placed on the second flexible printed cable 60, and the cables 42 and 60 are bonded to each other, except at both end portions. As shown in FIG. 9, the vias 47 are connected to the vias 63. Likewise, the vias 48 are connected to the vias 64. As shown in FIGS. 9 and 10, the vias 47 are connected to the vias 63.

As for the pairs of the first and second signal line patterns 45 and 46 of the parallel-transmission flexible printed cable member 41, each pair is sandwiched by two linear ground patterns 44 in the X1-X2 direction, as shown in the cross-sectional view of FIG. 10. The first and second signal line patterns 45 and 46 are also covered with the plane-type ground pattern 62 on the Z2 side. Thus, the first and second signal line patterns 45 and 46 are shielded from external noise.

The first and second signal line patterns 45 and 46, the linear ground pattern 44, and the plane-type ground pattern 62 are formed by etching with high size precision. Also, the thicknesses of the base sheets 43 and 61 are designed with high precision. Thus, the impedance of the first and second signal line patterns 45 and 46 is fixed precisely at 100 Ω, which is the target value.

As for the end of the parallel-transmission flexible printed cable member 41 on the Y1 side, the end portion 42*a* faces the end portion 60*a*, but is not connected thereto. As shown in the enlarged perspective view of FIG. 9, the ground terminal portions 44*a* and the ground terminal portions 62*a* are aligned, and the first signal terminal portions 45*a* and the second signal terminal portions 65*a* are aligned in the Z1-Z2 direction.

The ground terminal portions 44*a* and 62*a*, and the first and second signal terminal portions 45*a* and 65*a* are arranged in accordance with the arrangement of the contact portions 33*a* and 33*b*, and the contact portions 31*a* and 32*a* in the socket 20.

As for the end of the parallel-transmission flexible printed cable member 41 on the Y2 side, the end portion 42*b* faces the end portion 60*b*, but is not connected thereto, like the end on the Y1 side. The ground terminal portions 44*b* and the ground terminal portions 62*b* are aligned, and the first signal terminal portions 45*b* and the second signal terminal portions 65*b* are aligned in the Z1-Z2 direction.

[Plug Portion Forming Member 70]

Next, the plug unit forming member 70 is described in detail.

As shown in FIG. 7 and FIGS. 13A through 13E, the plug unit forming member 70 is a resin mold component with electric insulation properties. The plug unit forming member 70 is symmetrical about the Y-axis line at the center in the X1-X2 direction. The plug unit forming member 70 has base portions 71 and 72, a plug core potion 73 that is located between the base portions 71 and 72, guide arms 74 and 75 that extend in the Y1 direction from the ends of the base portions 71 and 72, and lock arms 76 and 77 that are formed on the respective outer surfaces of the guide arms 74 and 75.

Figure 13:
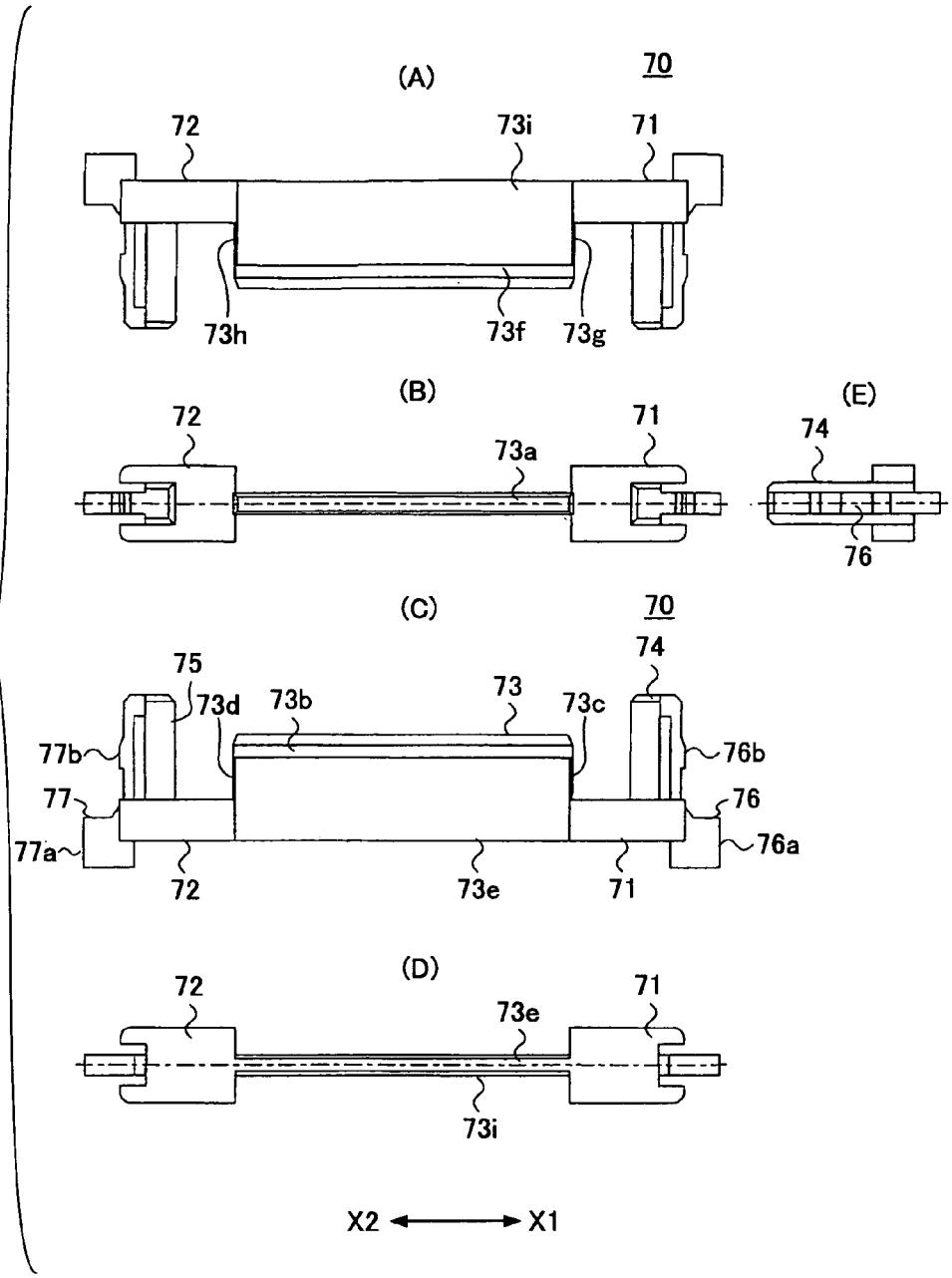
FIGS. 13A through 13D illustrate the plug portion forming member.

The plug core portion 73 has a long plate-like shape that extends in the X1-X2 direction. Also, the plug core portion 73 has such a size as to fit in the opening 24 of the socket 20, and protrude more forward than the base portions 71 and 72 in the Y1 direction. The plug core portion 73 has a tapered portion 73*a* at the end on the Y1 side. As shown in FIGS. 7 and 13C, the upper surface of the plug core portion 73 (the surface on the Z2 side) has convex line portions 73*b*, 73*c*, and 73*d* on the Y1 side, the X1 side, and the X2 side, so as to perform positioning in accordance with the thickness of the first flexible printed cable 42. The upper surface of the plug core portion 73 has a plane portion 73*e* inside the three convex line portions 73*b*, 73*c*, and 73*d*. The plane portion 73*e* has the shape corresponding to the end portion 42*a*. Also, the plane portion 73*e* is a shallower concavity with respect to any of the convex line portions 73*b*, 73*c*, and 73*d*. As shown in FIG. 13A, like the upper surface of the plug core portion 73, the lower surface (the surface on the Z2 side) of the plug core portion 73 has three convex line portions 73*f*, 73*g*, and 73*g*, an a shallow concave plane portion 73*i* having the shape corresponding to the end portion 60*a*.

Each of the guide arms 74 and 75 has a prismatic shape, and has such a size as to engage with the guide holes 25*a* and 25*b* of the socket 20.

The lock arms 76 and 77 are cantilever arms that are fixed on the Y1 side. The lock arms 76 and 77 have operating portions 76*a* and 77*a* on the Y2 side, and lock convex portions 76*b* and 77*b* in the middle.

[Parallel-Transmission Flexible Printed Cable 40 Equipped with Plug-type Connector Unit]

As shown in FIG. 7, the end portion 42*a* and the end portion 60*a* on the Y1 side of the parallel-transmission flexible printed cable member 41 are located apart from each other in the Z1-Z2 direction. As shown in FIGS. 1A and 1B, and FIGS. 3 and 4, the end portion 42*a* is accommodated by the plane portion 73*e* of the upper surface of the plug core potion 73 of the plug portion forming member 70, and is thus bonded and fixed to the plug core portion 73. Also, the end portion 60*a* is accommodated by the plane portion 73*i* of the lower surface of the plug core portion 73, and is thus bonded and fixed to the plug core portion 73. In this manner, the plug-type connector portion 80 is formed.

The top end of the end portion 42*a* meets the convex line portion 73*b*, so that the position of the end portion 42*a* in the Y1-Y2 direction is determined. The position of the end portion 42*a* in the X1-X2 direction is determined by the convex line portions 73*c* and 73*d* at both sides and the ends of the base portions 71 and 72. Likewise, the position of the end portion 60*a* in the Y1-Y2 direction is determined by the convex line portions 73*f*, 73*g*, and 73*h*, and the ends of the base portions 71 and 72. The position of the end portion 60*a* in the Y1-Y2 direction and the X1-X2 direction is determined by the convex line portions 73*c* and 73*d* at both sides, and the ends of the base portions 71 and 72.

The plug-type connector unit 80 has sufficient mechanical strength, as the plug core portion 73 serves as a strong core. In the plug-type connector unit 80, the ground terminal portions 44*a* and 62*a*, and the first and second signal terminal portions 45*a* and 65*a*, are precisely arranged in conformity to the arrangement of the contact portions 33*a* and 33*b* and the contact portions 31*a* and 32*a* in the socket 20.

The Y2-side end of the parallel-transmission flexible printed cable member 41 is also bonded to a plug portion forming member, thereby forming the plug-type connector unit.

The parallel-transmission flexible printed cable 40 equipped with a plug-type connector unit has the guide arms 74 and 75 engaged with the guide holes 25*a* and 25*b*, so as to perform positioning with respect to the socket 20. After that, the parallel transmission flexible printed cable 40 is forcibly pushed in the Y1 direction, so that the plug-type connector unit 80 is inserted into the opening 24 of the socket 20, as shown in FIG. 1B. Thus, the parallel-transmission flexible printed cable 40 is connected to the socket 20. Once connected, the parallel-transmission flexible printed cable 40 is put into the condition illustrated in FIG. 2B and illustrated by the chain double-dashed lines in FIGS. 3 and 4. More specifically, the ground terminal portions 44*a* and 62*a* are brought into contact directly with the fork-like contact portions 33*a* and 33*b* of the ground contacts 33. The first signal terminal portions 45*a* are brought into contact directly with the contact portions 31*a* of the first signal contacts 31. The second signal terminal portions 65*a* are brought into contact directly with the contact portions 32*a* of the second signal contacts 32.

In this structure, parallel signal transmission is performed between the parallel-transmission flexible printed cable 40 equipped with a plug-type connector unit and the socket 20. Especially, since the first and second signal terminal portions 45*a* and 65*a* at the end of the parallel-transmission flexible printed cable member 41 are electrically connected directly to the contact portions 31*a* and 32*a*, the loss in transmission characteristics can be minimized at the connecting points between the parallel-transmission flexible printed cable 40 and the socket 20.

Also, the lock convex portions 76*b* and 77*b* are engaged with the lock openings 26*a* and 26*b*, so that the parallel-transmission flexible printed cable 40 equipped with a plug-type connector unit is locked into the socket 20.

(Second Embodiment)

Figure 14:
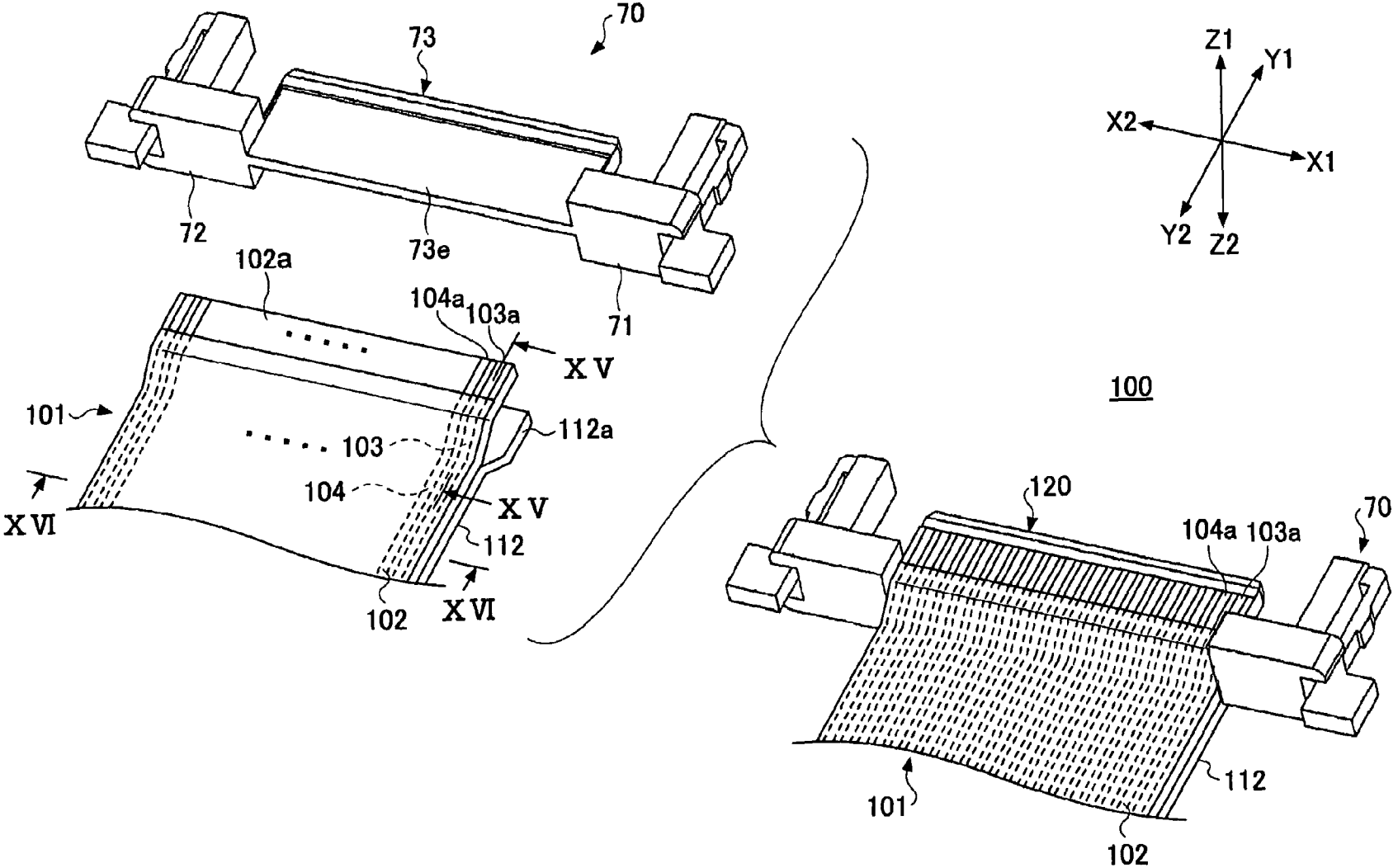
FIG. 14 is a perspective view of one end of a parallel-transmission flexible printed cable member equipped with a plug-type connector unit of a second embodiment of the present invention.

FIG. 14 illustrates a parallel-transmission flexible flat cable (FFC) 100 equipped with a plug-type connector unit of a second embodiment of the present invention. This parallel-transmission flexible flat cable 100 employs a parallel-transmission flexible flat cable member 101, instead of the parallel-transmission flexible printed cable member 41 of the first embodiment. The end of the parallel-transmission flexible flat cable member 101 is bonded to a plug unit forming member 70.

Figure 15:
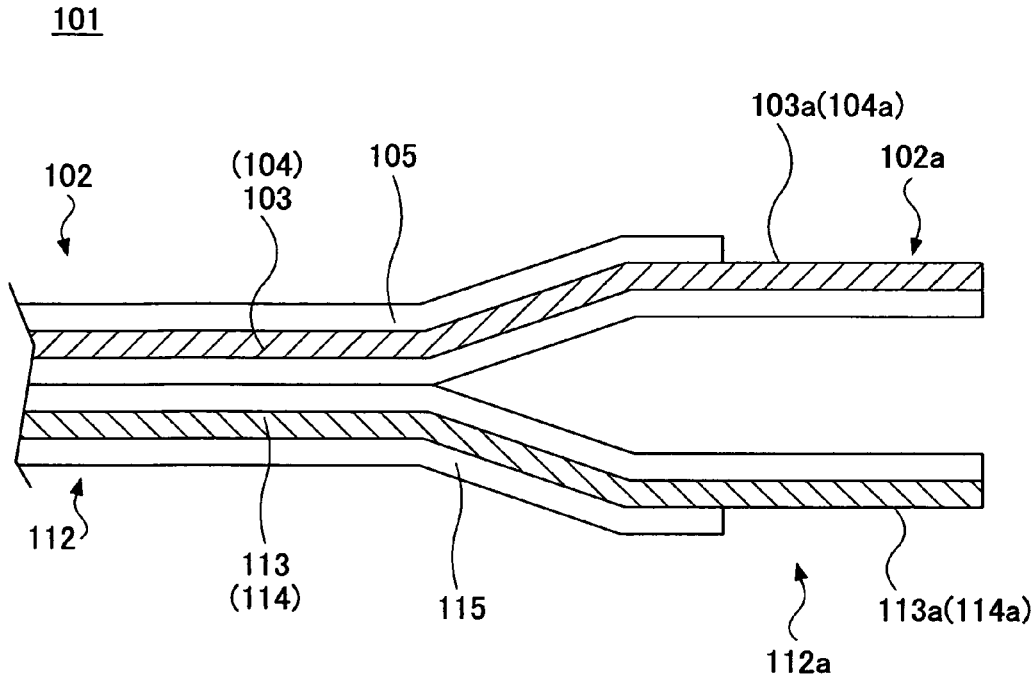
FIG. 15 is an enlarged cross-sectional view of the parallel-transmission flexible printed cable member, taken along the line XV—XV of FIG. 14.
Figure 16:
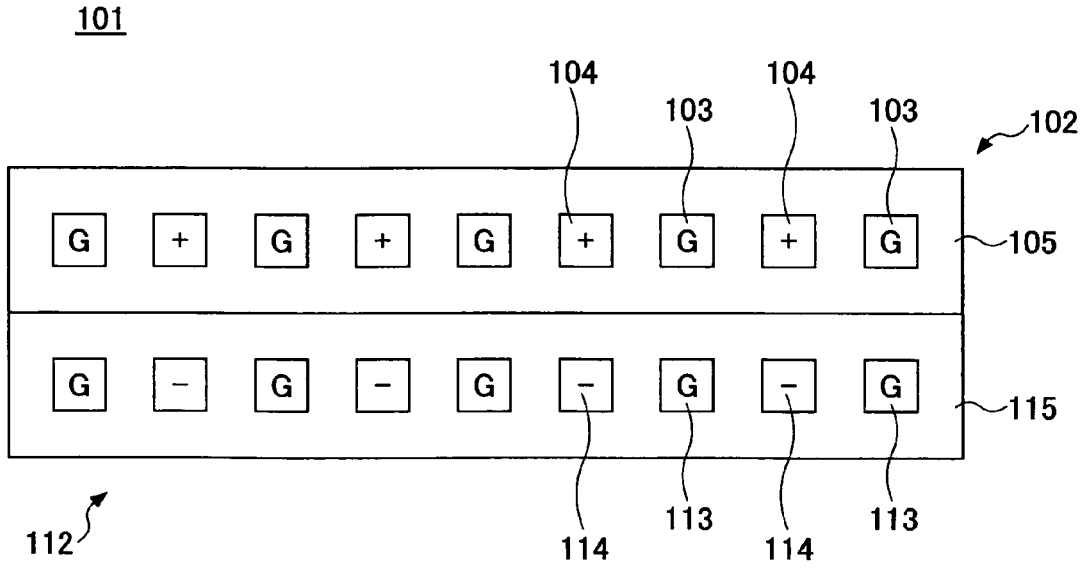
FIG. 16 is an enlarged cross-sectional view of the parallel-transmission flexible printed cable member, taken along the line XVI—XVI of FIG. 14.

The parallel-transmission flexible flat cable member 101 has a first flexible flat cable 102 placed on top of a second flexible flat cable 112 that is the same component as the first flexible flat cable 102, as shown in FIGS. 15 and 16. The first flexible flat cable 102 and the second flexible flat cable 112 are bonded to each other, except at both end portions. The parallel-transmission flexible flat cable member 101 is less expensive than the parallel-transmission flexible printed cable member 41 of the first embodiment.

The first flexible flat cable 102 has ground wires 103 and first signal wires 104 for transmitting positive signals. The ground wires 103 and the first signal wires 104 are alternately arranged, and are contained in an electrically insulating cover 105. The end portion 102*a* of the first flexible flat cable 102 has the cover 105 removed from its upper surface, so as to expose the wires 103 and 104. The exposed portions of the wires 103 and 104 form ground terminal portions 103*a* and first signal terminal portions 104*a* that are alternately arranged.

The second flexible flat cable 112 has ground wires 113 and second signal wires 114 for transmitting negative signals that have the same size as the positive signals but are directed in the opposite direction from the positive signal. The ground wires 113 and the second signal wires 114 are alternately arranged, and are contained in an electrically insulating cover 115. The end portion 101*a* of the second flexible flat cable 112 has the cover 115 removed from its lower surface, so as to expose the wires 113 and 114. The exposed portions of the wires 113 and 114 form ground terminal portions 113*a* and second signal terminal portions 114*a* that are alternately arranged.

The first flexible flat cable 102 is placed onto and bonded to the second flexible flat cable 112, so as to form the parallel-transmission flexible flat cable member 101. In this parallel-transmission flexible flat cable member 101, the first signal wires 104 and the second signal wires 114 are arranged in pairs in the Z1-Z2 direction. Also, the ground wires 103 and the ground wires 113 are arranged in pairs in the Z1-Z2 direction. Further, the pairs of first and second signal wires 104 and 114 and the pairs of ground wires 103 and 113 are alternately arranged in the X1-X2 direction.

The end portion 102*a* of the first flexible flat cable 102 of the parallel-transmission flexible flat cable member 101 is positioned and bonded onto the upper surface of the plug core portion 73 of the plug unit forming member 70. Meanwhile, the end portion 112*a* of the second flexible flat cable 112 is positioned and bonded onto the lower surface of the plug core portion 73 of the second flexible flat cable 112, thereby forming a plug-type connector unit 120.

The plug-type connector unit 120 has sufficient mechanical strength, as the plug core portion 73 serves as a strong core. In the plug-type connector unit 120, the ground terminal portions 103*a* and 113*a* and the first and second signal terminal portions 104*a* and 114*a* are precisely arranged in conformity to the arrangement of the contact portions 33*a* and 33*b* and the contact portions 31*a* and 32*a* in the socket 20.

Like the parallel-transmission flexible printed cable 40 equipped with a plug-type connector unit of the present invention 1, the parallel-transmission flexible flat cable 100 has the plug-type connector unit 120 inserted into the opening 24 of the socket 20. The ground terminal portions 103*a* and 113*a* and the first and second signal terminal portions 104*a* and 114*a* are brought into contact directly with the contact portions 33*a*, 33*b*, 31*a*, and 32*a*, so that the parallel-transmission flexible flat cable 100 is connected to the socket 20.

It is possible to employ a structure in which a component that forms a jack is used, instead of the plug unit forming member 70, and the end portion of the parallel-transmission flexible printed cable member or the parallel-transmission flexible flat cable member is changed to a jack-type connector unit with terminal units facing inward.

It is also possible to employ a structure in which a plug unit forming member is provided at the end portion of a flexible printed cable member or a flexible flat cable member for regular signal transmission.

It should be noted that the present invention is not limited to the embodiments specifically disclosed above, but other variations and modifications may be made without departing from the scope of the present invention.

This patent application is based on Japanese Priority Patent Application No. 2004-255797, filed on Sep. 2, 2004, the entire contents of which are hereby incorporated by reference.

What is claimed is:

1. A parallel-transmission flat cable that is equipped with a connector unit comprising:

a parallel-transmission flat cable member that has pairs of signal transmission paths and ground portions that are arranged alternately so as to enable parallel transmission, and has pairs of signal terminal portions and ground terminal portions exposed at either end of the parallel-transmission flat cable member; and a connector unit forming member that is provided at either end of the parallel-transmission flat cable member and forms a connector unit that has the signal terminal portions and the ground terminal portions of the parallel-transmission flat cable member serving as terminal portions, the connector unit being located at either end of the parallel-transmission flat cable member; and base members are formed integrally with a core part on both sides in said connector unit forming member, and first and second flat cables of said parallel-transmission flat cable member are located between the base members; and guide arms are formed in the base members for guiding connection of said connector unit with a second connector;

wherein the guide arms extend from ends of the base members;

the parallel-transmission flat cable member has the first flat cable placed onto and bonded to the second flat cable, except at either end, with said terminal portions being formed on an upper surface of either end of the first flat cable and a lower surface of either end of the second flat cable;

the connector unit forming member is a plate-like member that is interposed between either end of the first flat cable and the corresponding end of the second flat cable;

either end of the first flat cable is fixed onto an upper surface of the corresponding connector unit forming member, while either end of the second flat cable is fixed to a lower surface of the corresponding connector unit forming member; and the connector unit is of a plug type, with the terminal portions of the first flat cable being arranged on the upper surface, and the terminal portions of the second flat cable being arranged on the lower surface.

2. The parallel-transmission flat cable as claimed in claim 1, wherein:

the connector unit forming member has a shallow concave plane portion with an upper surface onto which the corresponding end of the first flat cable is positioned, and also has a shallow concave plane portion with a lower surface to which the corresponding end of the second flat cable is positioned;

either end of the first flat cable is accommodated in the shallow concave plane portion on the upper surface of the corresponding connector unit forming member, and is bonded and fixed to the upper surface of the corresponding connector unit forming member; and either end of the second flat cable is accommodated in the shallow concave plane portion on the lower surface of the corresponding connector unit forming member, and is bonded and fixed to the lower surface of the corresponding connector unit forming member.

3. A parallel-transmission flat cable member that constitutes a part of the parallel-transmission flat cable as claimed in claim 1, comprising:

said first flexible flat cable that has ground wires and first signal wires for transmitting positive signals, the ground wires and the first signal wires being alternately arranged in parallel and being provided within an electrically insulating covering body, the ground wires and the first signal wires having end portions at which the covering body is removed on the upper surface side, the exposed end portions of the ground wires forming ground terminal portions, the exposed end portions of the first signal wires forming first signal terminal portions, the ground terminal portions and the first signal terminal portions being alternately arranged; and said second flexible flat cable that has ground wires and second signal wires for transmitting negative signals that are of the same size as the positive signals and are directed in the opposite direction from the positive signals, the ground wires and the second signal wires being alternately arranged in parallel and being provided within an electrically insulating covering body, the ground wires and the second signal wires having end portions at which the covering body is removed on the lower surface side, the exposed end portions of the ground wires forming ground terminal portions, the exposed end portions of the second signal wires forming second signal terminal portions, the ground terminal portions and the second signal terminal portions being alternately arranged; and the first flexible flat cable being placed on the second flexible flat cable, the first flexible flat cable being bonded to the second flexible flat cable, except at both ends.

4. A parallel-transmission flexible printed wiring board member that is equipped with a connector unit, comprising:

a first flexible printed wiring board that has pairs of first signal line patterns for transmitting positive signals and second signal line patterns for transmitting negative signals that are of the same size as the positive signals but are directed in the opposite direction from the positive signals, and linear ground patterns, the pairs of first signal line patterns and second signal line patterns and the linear ground patterns being alternately arranged on the upper surface of a base sheet, ground terminal portions at the ends of the linear ground patterns and first signal terminal portions at the ends of the first signal line patterns being alternately arranged at the end portions of the base sheet;

a second flexible printed wiring board that has a plane-type ground pattern formed on the lower surface of a base sheet, ground terminal portions at the ends of the plane-type ground pattern and second signal terminal portions being alternately arranged at the end portions of the base sheet, the first flexible printed wiring board being placed on the second flexible printed wiring board, the first flexible printed wiring board being bonded to the second flexible printed wiring board, except at both ends, the second signal line patterns being conductively connected to the second signal terminal portions, the linear ground patterns being conductively connected to the plane-type ground pattern; and a connector unit forming member that is provided at either end of the parallel-transmission flexible printed wiring board member and forms a connector unit that has the signal terminal portions and the ground terminal portions of the parallel-transmission flat printed wiring board member serving as terminal portions, the connector unit being located at either end of the parallel-transmission flexible printed wiring board member.

5. A connector device comprising:

the parallel-transmission flexible printed wiring board member that is equipped with a connector unit as claimed in claim 4; and a second connector to which the connector unit of the parallel-transmission flexible printed wiring board member is connected.

6. A parallel-transmission flat cable that is equipped with a connector unit, comprising:

a parallel-transmission flat cable member that has pairs of signal transmission paths and ground portions that are arranged alternately so as to enable parallel transmission, and has pairs of signal terminal portions and ground terminal portions exposed at either end of the parallel-transmission flat cable member; and a connector unit forming member that is provided at either end of the parallel-transmission flat cable member and forms a connector unit that has the signal terminal portions and the ground terminal portions of the parallel-transmission flat cable member serving as terminal portions, the connector unit being located at either end of the parallel-transmission flat cable member;

wherein:

the parallel-transmission fiat cable member has a first flat cable placed onto and bonded to a second flat cable, except at either end, with terminal portions being formed on the upper surface of either end of the first flat cable and the lower surface of either end of the second flat cable;

the connector unit forming member is a plate-like member that is interposed between either end of the first flat cable and the corresponding end of the second flat cable;

either end of the first flat cable is fixed onto the upper surface of the corresponding connector unit forming member, while either end of the second flat cable is fixed to the lower surface of the corresponding connector unit forming member; and the connector unit is of a plug type, with the terminal portions of the first flat cable being arranged on the upper surface, and the terminal portions of the second flat cable being arranged on the lower surface; and the connector unit forming member has a shallow concave plane portion with an upper surface onto which the corresponding end of the first flat cable is positioned, and also has a shallow concave plane portion with a lower surface to which the corresponding end of the second flat cable is positioned;

either end of the first flat cable is accommodated in the shallow concave plane portion on the upper surface of the corresponding connector unit forming member, and is bonded and fixed to the upper surface of the corresponding connector unit forming member; and either end of the second flat cable is accommodated in the shallow concave plane portion on the lower surface of the corresponding connector unit forming member, and is bonded and fixed to the lower surface of the corresponding connector unit forming member; and base members are formed integrally with a core part on both sides in said connector unit forming member, and the first and second flat cables are located between the base members; and guide arms are formed in the base members for guiding connection of said connector unit with a second connector;

wherein the guide arms extend from ends of the base members.

7. A flat cable comprising:

a flat cable member that has signal transmission paths arranged in parallel, and has terminal portions exposed at either end;

a connector unit forming member that is attached to either end of the flat cable member, and forms a connector unit that shares the terminal portions of the flat cable member, the connector unit being provided at either end of the flat cable member;

wherein:

the parallel-transmission flat cable member has a first flat cable placed onto and bonded to a second flat cable, except at either end, with terminal portions being formed on the upper surface of either end of the first flat cable and the lower surface of either end of the second flat cable;

the connector unit forming member is a plate-like member that is interposed between either end of the first flat cable and the corresponding end of the second flat cable;

either end of the first flat cable is fixed onto the upper surface of the corresponding connector unit forming member, while either end of the second flat cable is fixed to the lower surface of the corresponding connector unit forming member; and the connector unit is of a plug type, with the terminal portions of the first flat cable being arranged on the upper surface, and the terminal portions of the second flat cable being arranged on the lower surface; and the connector unit forming member has a shallow concave plane portion with an upper surface onto which the corresponding end of the first flat cable is positioned, and also has a shallow concave plane portion with a lower surface to which the corresponding end of the second flat cable is positioned;

either end of the first flat cable is accommodated in the shallow concave plane portion on the upper surface of the corresponding connector unit forming member, and is bonded and fixed to the upper surface of the corresponding connector unit forming member; and either end of the second flat cable is accommodated in the shallow concave plane portion on the lower surface of the corresponding connector unit forming member, and is bonded and fixed to the lower surface of the corresponding connector unit forming member; and base members are formed integrally with a core part on both sides in said connector unit forming member, and the first and second flat cables are located between the base members; and guide arms are formed in the base members for guiding connection of said connector unit with a second connector;

wherein the guide arms extend from ends of the base members.

8. A parallel-transmission flat cable member that constitutes a part of the parallel-transmission flat cable comprising:

a flat cable member that has signal transmission oaths arranged in parallel, and has terminal portions exposed at either end;

a connector unit forming member that is attached to either end of the flat cable member, and forms a connector unit that shares the terminal portions of the flat cable member, the connector unit being provided at either end of the flat cable member; and base members are formed integrally with a core part on both sides in said connector unit forming member, and first and second flat cables of said parallel-transmission flat cable member are located between the base members; and guide arms are formed in the base members for guiding connection of said connector unit with a second connector;

wherein the guide arms extend from ends of the base members;

said first flexible flat cable that has ground wires and first signal wires for transmitting positive signals, the ground wires and the first signal wires being alternately arranged in parallel and being provided within an electrically insulating covering body, the ground wires and the first signal wires having end portions at which the covering body is removed on the upper surface side, the exposed end portions of the ground wires forming ground terminal portions, the exposed end portions of the first signal wires forming first signal terminal portions, the ground terminal portions and the first signal terminal portions being alternately arranged;

said second flexible flat cable that has ground wires and second signal wires for transmitting negative signals that are of the same size as the positive signals and are directed in the opposite direction from the positive signals, the ground wires and the second signal wires being alternately arranged in parallel and being provided within an electrically insulating covering body, the ground wires and the second signal wires having end portions at which the covering body is removed on the lower surface side, the exposed end portions of the ground wires forming ground terminal portions, the exposed end portions of the second signal wires forming second signal terminal portions, the ground terminal portions and the second signal terminal portions being alternately arranged; and the first flexible flat cable being placed on the second flexible flat cable, the first flexible flat cable being bonded to the second flexible flat cable, except at both ends.

* * * * *

UNITED STATES PATENT AND TRADEMARK OFFICE

CERTIFICATE OF CORRECTION

PATENT NO. : 7,166,803 B2
APPLICATION NO. : 11/119730
DATED : January 23, 2007
INVENTOR(S) : Atsushi Sakurai et al.

It is certified that error appears in the above-identified patent and that said Letters Patent is hereby corrected as shown below:

Column 11, Line 49, change “fiat” to --flat--.

Column 13, Line 16, change “cable” to --cable,--.

Column 13, Line 18, change “oaths” to --paths--.

Signed and Sealed this

Twenty-second Day of May, 2007

JON W. DUDAS
*Director of the United States Patent and Trademark Office*